United States Patent [19]

Katzman et al.

[11] Patent Number: 4,463,248

[45] Date of Patent: Jul. 31, 1984

[54] NON-SPITTING NOISELESS ELECTRIC STEAM VAPORIZER

[75] Inventors: Lawrence Katzman, New York; Edward Briggin, Brooklyn, both of N.Y.

[73] Assignee: Kaz Manufacturing Co., Inc., New York, N.Y.

[21] Appl. No.: 319,683

[22] Filed: Nov. 9, 1981

[51] Int. Cl.[3] ..... H05B 3/60; F22B 1/30; A61L 9/02

[52] U.S. Cl. ..... 219/284; 128/203.17; 219/275; 219/288; 261/142; 338/80

[58] Field of Search ..... 219/217–276, 219/284–295, 362; 338/80–86; 128/203.17, 203.27; 4/535–537; 261/142; 239/135, 136; 422/243, 285

[56] References Cited

U.S. PATENT DOCUMENTS

| | | | |
|---|---|---|---|
| 2,076,709 | 4/1937 | Deutsch | 219/271 X |
| 2,763,765 | 9/1956 | Duberstein et al. | 219/289 X |
| 2,843,891 | 7/1958 | Fisher | 219/275 X |
| 3,319,046 | 5/1967 | Katzman et al. | 219/284 X |
| 3,610,879 | 10/1971 | Katzman et al. | 219/284 X |
| 3,659,078 | 4/1972 | Rudstrom | 219/288 X |
| 3,714,392 | 1/1973 | Katzman et al. | 219/288 X |
| 3,971,913 | 7/1976 | Myklebust | 219/284 |
| 4,132,883 | 1/1979 | Grime | 219/284 |

*Primary Examiner*—A. Bartis

*Attorney, Agent, or Firm*—James & Franklin

[57] ABSTRACT

A cool-running noiseless, non-spitting electric steam vaporizer has a liquid container with a top opening closed by a cap having a steam outlet and a vent opening. An inner housing cooperates with the cap to define a steam collection space communicating with the steam outlet and includes a depending heating chamber communicating with the steam collection space and surrounding a pair of electrodes extending into the container from the cap. An opening between the steam collection space and the container allows excess steam produced during periods of rapid boiling to flow to the container. An isolated conduit extending through the steam collection space from the container interior to the vent opening allows the excess steam to be exhausted without noise or spitting. An insulative double walled outer housing surrounds the heating chamber.

20 Claims, 6 Drawing Figures

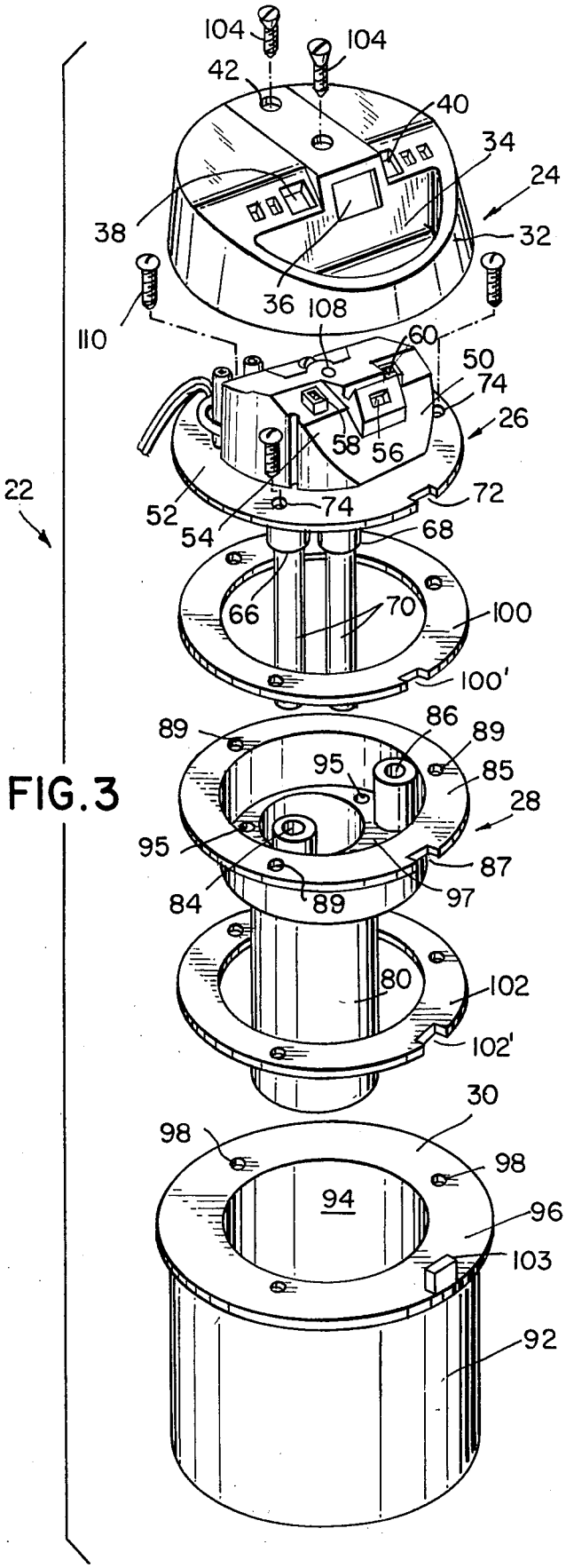
FIG.3
FIG.4
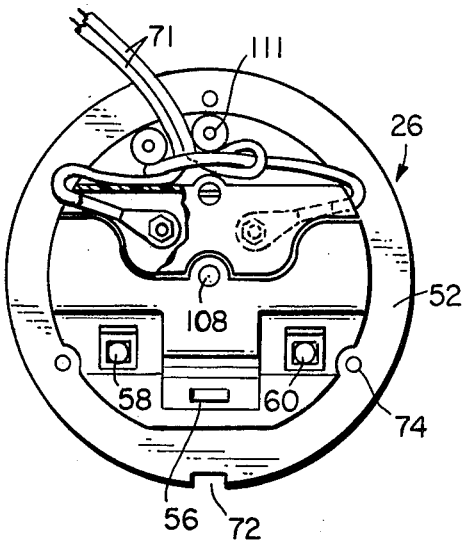
FIG.5
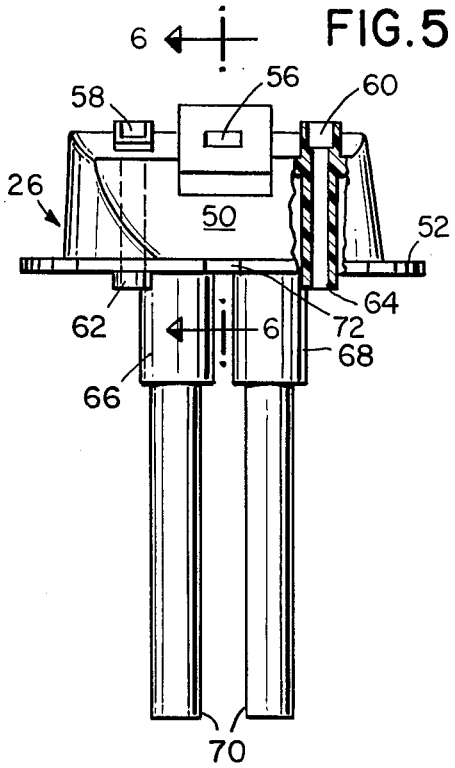
FIG.6
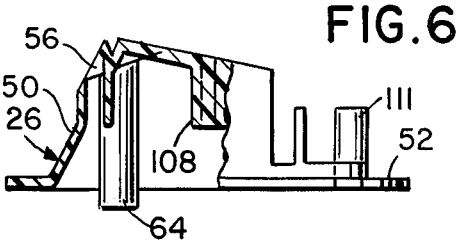

NON-SPITTING NOISELESS ELECTRIC STEAM VAPORIZER

BACKGROUND OF THE INVENTION

1. Field of the Invention

This invention relates to an electric steam vaporizer of the type disclosed in U.S. Pat. No. 3,610,879 issued Oct. 5, 1971 for "Insulated Heating Chamber for Vaporizers."

2. State of the Prior Art

In U.S. Pat. No. 3,610,879, an improved double wall heating chamber was provided primarily for safety of operation and to lower the temperature of the water in the varporizer container.

While the temperature of the exterior fluid in the container was lowered, the problem of spitting still occurred until, in U.S. Pat. No. 3,714,392 issued Jan. 30, 1973 for "Non-Spitting Vaporizer Unit, a vaporizer having means for eliminating spitting of the interior boiling water as it exited from the vaporizers was achieved.

However, the steam as it departed from the vaporizer maintained a characteristic type of noise due to variations in the type of fluid flow. The present invention seeks to reduce or eliminate such noise, thus permitting the user to more easily fall asleep during operation, as when the vaporizer is employed with a sleeping infant or other patients.

SUMMARY OF THE INVENTION

The present invention achieves a substantially silent running, low temperature non-spitting varporizer by providing vent openeings in the outer cap for permitting excessive steam to be exhausted during periods of rapid boiling and near the end of the period of operation as the contents of the container have become depleted. The vent openings serve to prevent overboiling and needless noise. The vent openings communicate through vents and tubes in the inner cap to conduit means of an inner housing which includes the heating chamber. The inner cap carries electrodes which extend into the heating chamber. An insulative double walled outer housing is provided and the entire assembly is suspended from a top cap which seats on an open mouth container.

BRIEF DESCRIPTION OF THE DRAWINGS

FIG. 3 is an exploded perspective view of the major parts of the present invention;

FIG. 4 is a top plan view partially broken away of the inner cap;

FIG. 5 is a side elevational view with parts broken away of the inner cap with depending electrodes; and FIG. 6 is a vertical sectional detail view of the inner cap taken along the line 6—6 of FIG. 5.

DETAILED DESCRIPTION OF THE INVENTION

Figure 1:
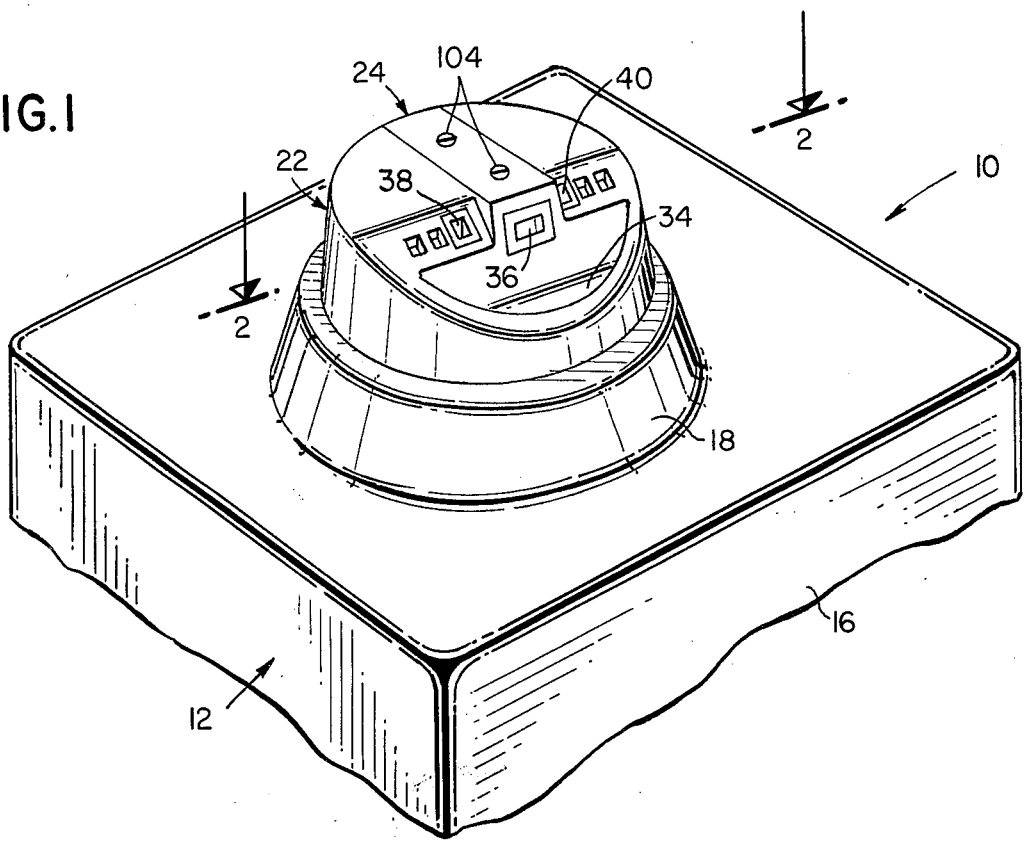
FIG. 1 is a partial perspective view of the vaporizer constructed in accordance with the present invention.

With continuing reference to the accompanying drawings wherein like reference numerals designate similar parts throughout the various views, reference numeral 10 generally designates a vaporizer constructed in accordance with the concepts of the present invention. The vaporizer 10 includes a pair of easily assembled parts including a container or outer housing 12, having a bottom 14, side walls 16, and a contoured top 18 provided with an opening 20. The top 18 is contoured to provide a seat for the heating assembly, generally indicated at 22.

The heating assembly 22, as can be seen best in FIG. 3, includes four main parts, namely a top cap 24, an inner cap 26, an inner housing 28, and an insulative outer housing 30.

The top cap 24 is a one-piece molded body 32 having a well 34 for receiving medicament spaced below and in front of the steam outlet opening 36 so that emitted steam can pick up the medication. On either side of the steam outlet opening 36 are safety vent openings 38 and 40. Apertures 42 are provided for screws 104 used to detachably secure the top cap 24 to the inner cap 26.

The inner cap 26 has a complex unitary molded body 50 having a peripheral flange 52 and having an upper wall 54 contoured to conform generally with parts of the under surface of the top cap 24. The upper wall 54 is provided with a steam outlet 56 in alignment with the steam outlet opening 36 and vents 58 and 60 in alignment with vent openings 38 and 40. Integral with the body 50 are a pair of tubes 62 and 64 which communicate with the vents 58 and 60. A pair of electrode holding cylinders 66 and 68 are integral with the body 50 and electrodes 70 depend therefrom which electrodes are connected through conductors to an appliance cord, not shown, of conventional construction and in the manner known in the art as exemplified by U.S. Pat. No. 3,319,046, issued May 9, 1967 for "Electrode and Heating Chamber for Vaporizer." For alignment purposes a notch 72 or the like is formed in the flange 52 and holes 74 are provided therein for assembly.

Figure 2:
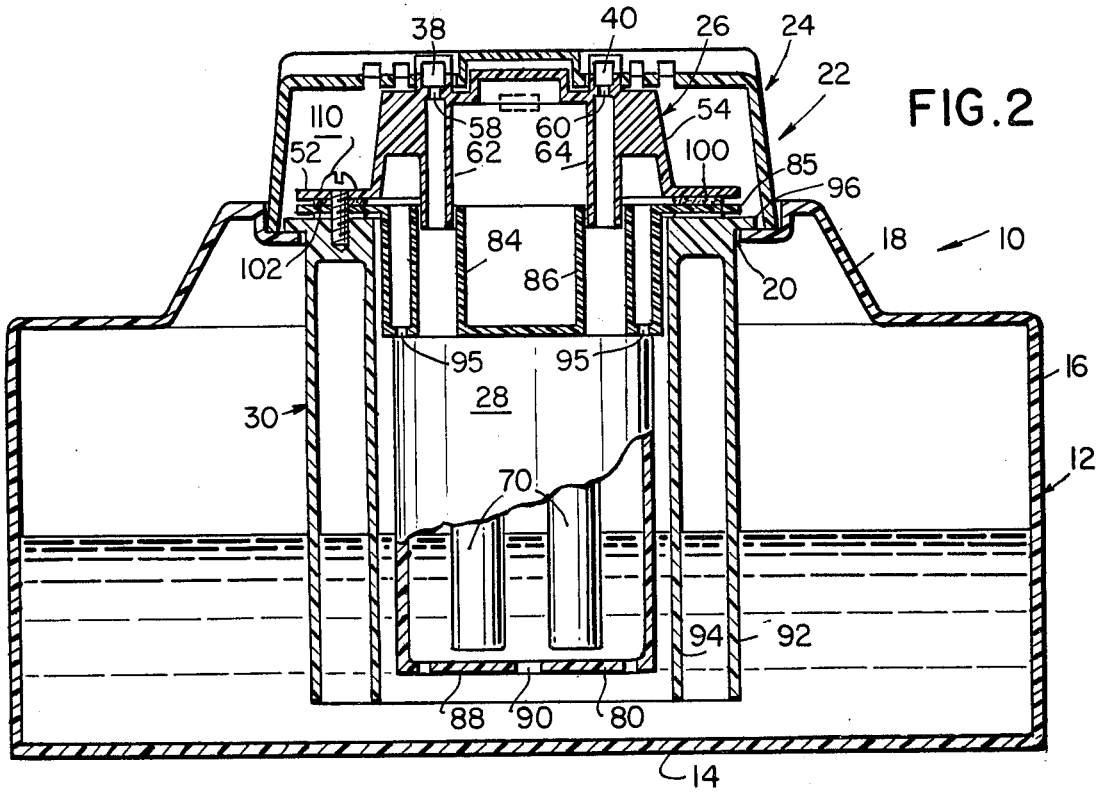
FIG. 2 is a vertical sectional view taken along the plane of line 2—2 in FIG. 1.

The electrodes 70 extend into the inner housing 28 and down into the heating chamber 80 which is of reduced diameter. Openings 95 are formed in the bottom wall 97 of the larger diameter portion of the inner housing 28. Isolated from the heating chamber 80 are a pair of conduits 84 and 86 into which the tubes 62 and 64 telescopingly seat and communicate. The conduits 84 and 86 are open at their bottoms. The heating chamber 80 has its bottom 88 provided with a water inlet opening 90 (FIG. 2). The inner housing 28 has a peripheral flange 85 provided with a notch 87 for alignment with notch 72 and holes 89 therethrough.

The heating chamber 80 is surrounded by the outer housing 30 which is provided with insulative double walls 92 and 94 and has a peripheral flange 96 provided with threaded recesses 98. The inner wall 94 of the outer housing 30 surrounds and is spaced from the heating chamber 80, and the openings 95 communicate with the space between that inner wall 94 and the heating chamber 80.

Gaskets 100 and 102 are disposed respectively between flanges 52 and 85, and flanges 85 and 96. Gaskets 100 and 102 are provided with notches 100' and 102' respectively, and the flange 96 is provided with an upstanding lug 103 received within the notches 102', 87, 100' and 72 when the parts are assembled for rotational alignment of the parts.

The parts are assembled using a pair of screws 104 which extend through holes 42 into threaded recesses 108 and 111 in the inner cap 26. The flanges 52, 85 and 96 are arranged in superimposed relationship and screws 110 extend through holes 74 and 89 and aligned holes in the gaskets 100 and 102 and are threadedly secured in recesses 98.

With the entire device assembled, the electrodes 70 extend into the heating chamber 80, which, through opening 90, fills with water from the container 12. When the device is energized steam is generated in the heating chamber 80 and that steam rises into the steam collection space formed between the cap 26 and the inner housing 28, the steam then escaping through steam outlet 56 and steam outlet opening 36. If, for any reason, the total power used by the electrodes is greatly increased, such as when excessive amounts of electrolytes, such as salt, are used in contradiction to instructions, steam in excess of that which would otherwise be generated in predetermined amounts and which would pass out of the steam outlet 56 will now also be forced down through openings 95 out of the heating chamber 80 and into the interior of the container 12, and more specifically into the space between the heating chamber 80 and the inside wall 94 of the outer housing 30. The steam will then pass upwardly into conduits 84 and 86 and thence through tubes 62 and 64 to vents 58 and 60 in the inner cap 26 for discharge through the vent openings 38 and 40 in the top cap 24. The conduits 84 and 86 and tubes 62 and 64 define closed isolated steam flow paths which traverse the steam collection space formed between the inner cap 26 and the inner housing 28. They therefore isolate the excess steam flowing through openings 95 into the container for discharge through vents 38 and 40 from the normal flow of steam discharged directly from the steam collection space through outlet 56 and outlet opening 36. This safety arrangement prevents noise as well as spitting of the interior boiling water such as would otherwise be caused by steam forcing its way under too much pressure through steam outlet 56.

What is claimed is:

1. A vaporizer comprising a liquid container having an upper opening, a cap positioned on said container overlying said upper opening, said cap having a steam outlet opening and a vent opening, electrodes depending into said container from said cap, at least one tube depending from said cap and communicating with said vent opening, an inner housing cooperating with said cap to define a steam collection space communicating with said steam outlet and including a depending heating chamber surrounding said electrodes and having a water inlet opening therein communicating with the container, an opening between said steam collection space and the interior of said container, said inner housing including isolated conduit means open to said container externally of said heating chamber, said at least one tube communicating with said conduit means to form a closed isolated steam flow path from the interior of said container to said vent opening, and fastening means detachably securing said cap and said inner housing in an assembled condition.

2. The vaporizer of claim 1, in which at least one of said tube and said conduit passes through said steam collection space.

3. The vaporizer of claim 1, in which said tube and said conduit pass through said steam collection space.

4. The vaporizer of claim 1, in which said vent opening is located adjacent said steam outlet opening.

5. The vaporizer of claim 1, comprising a heat insulating section in said container surrounding and spaced from said heating chamber, said opening between said steam collection space and interior of said container and said conduit means communicating with the space between said insulated section and said heating chamber.

6. The vaporizer of claim 5, in which said cap, said inner housing and said heat insulating section have abutting flanges.

7. The vaporizer of claim 6, in which said fastening means extends through said abutting flanges.

8. The vaporizer of claim 1, in which said cap and said inner housing have abutting flanges.

9. The vaporizer of claim 8 in which said fastening means extends through said abutting flanges.

10. In the vaporizer of claim 1, an outer housing surrounding said heating chamber in spaced relation thereto, said fastening means detachably securing said outer housing to the other parts.

11. A vaporizer comprising a liquid container having an upper opening, a top cap positioned on said container overlying said opening, said cap having a steam outlet opening therein and at least one vent opening therein, an inner cap secured at least partially within said top cap and having a steam outlet communicating with said steam outlet opening of said top cap and having a vent communicating with said at least one vent opening, electrodes depending into said container from said inner cap, at least one tube depending from said inner cap and communicating with said vent, an inner housing cooperating with said inner cap to define a steam collection space communicating with said steam outlet and including a depending heating chamber surrounding said electrodes and having a water inlet opening therein communicating with the container, an opening between said steam collection space and the interior of said container, said inner housing including isolated conduit means open to said container externally of said heating chamber, said at least one tube communicating with said conduit means to form a closed isolated steam flow path from the interior of said container, through the steam collection space to said vent, and fastening means detachably securing said top cap, said inner cap and said inner housing in an assembled condition.

12. The vaporizer of claim 11, in which said vent opening is located adjacent said steam outlet opening.

13. The vaporizer of claim 11, further comprising a heat insulating section in said container surrounding and spaced from said heating chamber, said opening between said steam collection space and the interior of said container and said conduit means communicating with the space between said insulated section of said heating chamber.

14. The vaporizer of claim 13, in which said inner cap, said inner housing and said heat insulating section have abutting flanges.

15. The vaporizer of claim 14, in which said fastening means extends through said abutting flanges.

16. The vaporizer of claim 11, in which said inner cap and said inner housing have abutting flanges.

17. The vaporizer of claim 16, in which said fastening means extends through said abutting flanges.

18. A vaporizer comprising a liquid container having an opening closed by a cover, a heating chamber in said container defining a steam-receiving space and having an aperture through which liquid in said container can enter said chamber, heating means in said chamber, steam outlet means in said cover communicating with said heating chamber through which steam normally produced by said heating means passes, a vent opening in said cover, said heating chamber having an opening located above said aperture, communicating with said steam-receiving space, and leading to the interior of said container outside said chamber, enclosed isolated conduit means extending from said container interior to said vent opening in said cover and passing through said steam-receiving space, excess steam passing through said opening into said container interior, through said conduit means, and out through said vent opening.

19. The vaporizer of claim 18, in which said vent opening is located adjacent said steam outlet means.

20. The vaporizer of claim 18, in which said vaporizer comprises a heat insulating section in said container surrounding and spaced from said heating chamber, said opening and said conduit means communicating with the space between said insulated section and said heating chamber.

* * * * *